US008802612B2

(12) United States Patent
Wong et al.

(10) Patent No.: US 8,802,612 B2
(45) Date of Patent: Aug. 12, 2014

(54) DETERGENT PACKET

(71) Applicant: Aicello Chemical Co., Ltd., Aichi (JP)

(72) Inventors: Carlton J. Wong, Princeton, NJ (US); Yuki Yasui, Toyokawa (JP)

(73) Assignee: Aicello Corporation, Toyohashi, Aichi (JP)

( * ) Notice: Subject to any disclaimer, the term of this patent is extended or adjusted under 35 U.S.C. 154(b) by 0 days.

(21) Appl. No.: 13/752,609

(22) Filed: Jan. 29, 2013

(65) Prior Publication Data

US 2013/0206638 A1 Aug. 15, 2013

Related U.S. Application Data

(60) Provisional application No. 61/633,357, filed on Feb. 9, 2012.

(51) Int. Cl.
*C11D 17/04* (2006.01)
*C11D 3/04* (2006.01)

(52) U.S. Cl.
USPC ..... 510/296; 510/221; 510/439

(58) Field of Classification Search
USPC ..... 510/296, 220, 439, 221
See application file for complete search history.

(56) References Cited

U.S. PATENT DOCUMENTS

| | | | | |
|---|---|---|---|---|
| 3,983,079 | A * | 9/1976 | Spadini et al. | 510/237 |
| 5,253,759 | A | 10/1993 | Gouge et al. | |
| 5,341,932 | A | 8/1994 | Chen et al. | |
| 6,605,578 | B1 * | 8/2003 | Fleckenstein et al. | 510/221 |
| 6,632,785 | B2 | 10/2003 | Pfeiffer et al. | |
| 6,727,215 | B2 * | 4/2004 | Roberts et al. | 510/296 |
| 6,787,512 | B1 | 9/2004 | Verrall et al. | |
| 7,271,141 | B2 | 9/2007 | Kaiser et al. | |
| 7,557,075 | B2 | 7/2009 | Fregonese et al. | |
| 7,642,226 | B2 | 1/2010 | Verrall et al. | |
| 7,790,664 | B2 * | 9/2010 | Harrington et al. | 510/220 |
| 2006/0148668 | A1 * | 7/2006 | Verrall et al. | 510/293 |
| 2006/0165625 | A1 | 7/2006 | Verrall et al. | |
| 2009/0291282 | A1 * | 11/2009 | Kitamura et al. | 428/220 |
| 2011/0188784 | A1 | 8/2011 | Denome et al. | |

OTHER PUBLICATIONS

International Search Report and Written Opinion of the International Searching Authority for International Application No. PCT/US13/24722 dated Apr. 19, 2013.

* cited by examiner

*Primary Examiner* — Lorna M Douyon
(74) *Attorney, Agent, or Firm* — Collard & Roe, P.C.

(57) ABSTRACT

A detergent packet includes a liquid detergent contained within a water soluble pouch. The water soluble pouch is formed from a film including at least one of a polymer of hydrolyzed vinyl acetate and a copolymer of hydrolyzed vinyl acetate and a second monomer. The liquid detergent includes between 5 wt % and 60 wt % water and between 0.5 wt % and 15 wt % inorganic sulfate.

13 Claims, No Drawings

DETERGENT PACKET

CROSS REFERENCE TO RELATED APPLICATIONS

This application claims priority under 35 U.S.C. §119(e)(i) and the benefit of co-pending U.S. Provisional Application No. 61/633,357 entitled "Pouch for liquid laundry detergent packaging" filed on Feb. 9, 2012, which is incorporated in its entirety by reference herein.

BACKGROUND OF THE INVENTION

1. Field of the Invention

The invention relates to detergent packets, in particular detergent packets including liquid detergent contained within a water soluble pouch.

Liquid detergent is used in the field of laundry, glass, floor and carpet cleaning. Consumers widely accept the packaging of liquid detergent in pre-measured amounts known as unit doses because of its convenience. Consumers have a tendency to use more detergent than sufficient or necessary, thus the unit dose detergent packaging prevents over-consumption and is more environmentally-friendly.

When liquid detergent is packed in a pouch, the pouch must be dissolved in water for the liquid detergent to be used for cleaning objects. Consumers have demanded higher cleaning performance from liquid detergent. As a result, different active ingredients have been combined in liquids detergents to achieve higher performance. Some kinds of active ingredients may chemically react with one another when mixed. In order to prevent this chemical reaction, a separation packaging in a pouch may be employed.

Liquid detergents may contain glycols as a diluent. In order to reduce costs, liquid detergent manufacturers have begun using water as a diluent. Water soluble pouches, however, do not have resistance against high water contents. In particular, water soluble pouches by their nature dissolve in cold water. The dissolution of a water soluble pouch packed with a liquid detergent having a high water content descends with time. Moreover, the surface of a water soluble pouch packed with a liquid detergent having a high water content will become sticky. Accordingly, it has previously been difficult or impossible to provide a water soluble pouch containing a high water content liquid detergent having acceptable performance properties.

2. The Prior Art

U.S. Pat. No. 5,341,932 to Chen et al. relates to hazardous materials containing water with various ions but does not disclose a liquid detergent packaging or specific limitation for each salt concentration in the formulation. Chen et al. also fails to disclose the advantageous effect of adding sulfate on the deterioration of a water soluble pouch when it is dissolved in water. U.S. Pat. No. 7,271,141 to Kaiser et al. relates to water soluble packages containing polyphosphate builder and special ratios of potassium to sodium ions. A detergent packet according to an embodiment of the invention does not require potassium ions or a special ratio of potassium to sodium ions.

U.S. Pat. No. 7,557,075 to Fregonese et al. relates to water soluble package with a liquid detergent containing a high volume water content, a polyphosphate builder material and Sorbitol. Fregonese et al. does not mention sulfate salts or the advantageous effect of adding sulfate on the deterioration of a water soluble pouch when it is dissolved in water. U.S. Pat. No. 5,253,759 to Gouge et al. relates to a water soluble bag in bag arrangement for agrochemicals packaging wherein the bag in bag arrangement prevents the interaction of chemicals by separating. Gouge et al. does not disclose a detergent packaging or high water content packed chemicals.

U.S. Pat. No. 6,632,785 to Pfeiffer at al. relates to water soluble sachet packed gel form detergents and high volume of water. Pfeiffer at al. does not disclose a liquid detergent packaging, specific limitations for each salt concentration in the formulation or the advantageous effects of adding sulfate on the deterioration of a water soluble pouch when it is dissolved in water. U.S. Pat. No. 7,642,226 to Verrall at al. relates to a water soluble co-polymer film packed a liquid detergent and film thickness range. U.S. Pat. No. 6,787,512 to Verrall at al. relates to a water soluble co-polymer film containing a unit dose of liquid detergent. The Verrall at al. patents do not mention a liquid detergent containing water.

SUMMARY OF THE INVENTION

The invention relates to detergent packets, in particular detergent packets including liquid detergent contained within a water soluble pouch.

A detergent packet according to an aspect of the invention includes a water soluble pouch and a liquid detergent contained within the water soluble pouch. The water soluble pouch may be formed from a film including at least one of a polymer of hydrolyzed vinyl acetate and a copolymer of hydrolyzed vinyl acetate and a second monomer. The liquid detergent may include between 5 wt % and 60 wt % water and between 0.5 wt % and 15 wt % inorganic sulfate.

In a further aspect of the invention a cation of the inorganic sulfate may include sodium, potassium, magnesium or aluminum. In a further aspect of the invention the second monomer may include maleic acid, itaconic acid, methyl acrylate and/or 2-acrylamido-2-methylpropanesulfonic acid.

In a further aspect of the invention a degree of hydrolysis of the film expressed as a mol percentage of vinyl acetate units converted to vinyl alcohol units may be 70 mol % to 100 mol %. In a further aspect of the invention the film may be between 50 microns and 100 microns thick.

In another aspect of the invention, the detergent packet further has an outer water soluble pouch packed with both the water soluble packet and an outer liquid detergent contained within the outer water soluble pouch. The outer liquid detergent may include less than 15 wt % of water and less than 10 wt % of inorganic sulfate.

In a further aspect of the invention, a cation of the inorganic sulfate of the outer liquid detergent may include sodium, potassium, magnesium or aluminum. In a further aspect of the invention, the outer water soluble pouch may be formed from a film including a polymer of hydrolyzed vinyl acetate and/or a copolymer of hydrolyzed vinyl acetate and a second monomer.

In a further aspect of the invention, the second monomer of the outer water soluble pouch may include maleic acid, itaconic acid, methyl acrylate and/or 2 acrylamido-2-methylpropanesulfonic acid.

In a further aspect of the invention, a degree of hydrolysis of the outer water soluble pouch expressed as a mol percentage of vinyl acetate units converted to vinyl alcohol units may be 70 mol % to 100 mol %. In a further aspect of the invention, the film of the outer water soluble pouch may be between 50 microns and 100 microns thick.

A water soluble pouch according to aspects of the invention can withstand high water content in a liquid or gel detergent by adding inorganic sulfate salts into the liquid laundry detergent. The amount of added inorganic sulfate salts may be from 0.5 wt % to 15 wt %. One inorganic sulfate which may be added to the liquid detergent is sodium sulfate salt, which may be preferable due to its efficiency, safety and economy.

The solubility of a water soluble pouch decreases by adding water into liquid detergents. Adding the salts can solve a deterioration problem of the water soluble pouch. The added inorganic sulfate function to terminating the dissolution from inside of the water soluble pouch and to retard the saponification reaction of the water soluble film.

The thickness of film making up a water soluble pouch according to an aspect of the invention may be more than 50 microns to prevent leakage of the liquid laundry detergent. At a thickness below 50 microns, leakage occurs. At a thickness of above 100 microns, however, the dissolution rate of the pouch in water becomes slow and the film cost is not economical. Thus, a preferable film thickness is, for example, between 50 and 100 microns, in particular between 60 microns and 90 microns.

A water soluble pouch according to aspect of the invention may be made by a hydrolyzed polymer of vinyl acetate and/or a hydrolyzed copolymer of vinyl acetate and a second monomer. A degree of hydrolysis of the film, expressed as a mol percentage of vinyl acetate units converted to vinyl alcohol units, may be 70 mol % to 100 mol %. The second monomer in the copolymer film may be maleic acid, itaconic acid, methyl acrylate and/or 2-acrylamido-2-methylpropanesulfonic acid.

When the concentration of inorganic salts in the liquid detergent is less than 0.5% wt %, pinholes may be generated in the water soluble pouch during storage. When the concentration of inorganic salts in the liquid detergent is greater than 20 wt %, however, the liquid detergent loses its stability and phase separation may occur.

A maximum water content of the liquid detergent in an aspect of the invention is 60 wt %. The addition of inorganic salts cannot prevent generation of leakage when the liquid detergent water content exceeds 60 wt %. Likewise, the addition of inorganic salts cannot prevent the deterioration for water solubility of the pouch when the liquid detergent water content exceeds 60 wt %.

The surface of the water soluble pouch gradually becomes sticky after being packed with a high water content liquid detergent. This stickiness problem can be solved by packing the pouch (an inner water soluble pouch) in an outer water soluble pouch also packed with a liquid detergent. The liquid detergent in the outer water soluble pouch may contain a smaller amount of water than that in the inner water soluble pouch. The liquid detergent in the outer water soluble pouch may contain water and inorganic sulfates. Moreover, the type of liquid detergent in the outer water soluble pouch may be the same as or different from type of liquid detergent in the inner water soluble pouch. This pouch in a pouch arrangement according to an aspect of the invention can solve the induced stickiness problems occurring in water soluble pouches containing high water content liquid detergents.

Other problems occurring in water soluble pouches containing high water content liquid detergents which are overcome in a detergent packet according to aspects of the invention include machinability, blocking between pouches, pin holes and breakage of a pouch. The shape of a water soluble pouch according to aspects of the invention may be a capsule, a pillow, a pyramid or any other suitable shape.

DETAILED DESCRIPTION OF EMBODIMENTS OF THE INVENTION

A liquid detergent used in a detergent packet according to embodiments of the invention is generally used in house and may be any liquid detergent having the specified water content and inorganic sulfate. The ingredients of a liquid or gel detergent may include alkyl-ether sulphate, linear-alcohol ethoxylate, monoethanolamine, triethanolamine, ethyleneglycol, propyleneglycol, enzymes, dyestuff and/or flagrance. The viscosity of the liquid detergent depends on the selected ingredients. It is also possible to add a thickener to the liquid detergent as an ingredient to prevent a leakage of a liquid detergent. The ethyleneglycol or propyleneglycol in the liquid detergent composition may be replaced with water to reduce costs.

A water soluble pouch used in a detergent pack according to embodiments of the invention may be made by a thermoforming method or a vertical form-fill-seal (FFS) method.

The thermoforming method for making a water soluble pouch may be as follows. First, a bottom film is thermoformed by heating and vacuuming to make a pocket and then the pocket is filled with a liquid detergent. Next, a cover film is put on the pocket and the pocket is sealed with water or heat, and cut.

The form-fill-seal method for making a water soluble pouch may be as follows. First, a film is folded vertically and sealed with overwrapped edges both vertically and horizontally by heating. A liquid detergent is filled into the folded film and the top part is sealed and cut horizontally.

A hydrolyzed polymer of vinyl acetate or a hydrolyzed copolymer of vinyl acetate and a second monomer film used in a detergent packet according to embodiments of the invention may contain a plasticizer. The plasticizer may include glycerol, ethylene glycol, propylene glycol and/or trimethylolpropane. The amount of plasticizer may be 5 wt % to 30 wt %. At a plasticizer content below 5 wt %, the cold resistance of the film may be lost. At a plasticizer content above 30 wt %, the ability to process film into a pouch becomes poor. A preferred plasticizer content, is for example, 10 wt % to 20 wt %. A hydrolyzed polymer of vinyl acetate or a hydrolyzed copolymer of vinyl acetate and a second monomer film used in a detergent packet according to embodiments of the invention may also contain one or more anti blocking agents and surfactants.

The thickness of the film is very important to prevent leakage of a liquid detergent from the pouch in a detergent packet according to an embodiment of the invention. In a thermoforming method, a bottom film thickness becomes thinner during stretching to form a pocket. The film thickness should be at least 50 microns. At film thicknesses of less than 50 microns, pinholes may be created in the thinner areas of a bottom film. A preferred film thickness for a detergent packet according to embodiments of the invention is for example, 60 microns to 100 microns. At film thicknesses above 100 microns, the cost becomes higher and the dissolution time in water becomes longer. The costs for such films may make them unsuitable for a commodity item such as a detergent packet which must have a reasonable price.

The functions of an inorganic sulfate in the liquid detergent composition in detergent packets according to embodiments of the invention include the creation of a thin layer inside of the water soluble pouch. This thin layer is water-insoluble and keeps the shape of a pouch. A pouch having this thin layer can easily dissolve by contacting the pouch with a large volume of water from outside of the pouch. The inorganic sulfate also works as a water softener for the washing water after dissolving.

Liquid detergent components may decrease the solubility of a water soluble pouch during storage. Moreover, high water contents in a liquid detergent accelerate the decrease in solubility. An inorganic sulfate added to the liquid detergent inhibits the decreasing of water solubility.

A water content of less than 15 wt % in a liquid detergent may not make the surface of pouch sticky even after long time storage. In commercial practice, the problem of the surface of the pouch becoming sticky may be solved by powdering. The powdering procedure, however, makes production of pouches more difficult.

EXAMPLES

Example 1

A pouch was made from a 88 mol % hydrolyzed polyvinyl acetate (JP18, Japan Vam & Poval Co., Ltd) film. 18 wt % of glycerol was formulated in the film. The film thickness was 90 microns. The size of the pouch was 10 cm×15 cm. An outer package was 50 micron thick high density polyethylene. $Na_2SO_4$ was added in the liquid detergent. The results are shown in Table 1.

TABLE 1

| | Liquid detergent (a) gram | Liquid detergent (b) gram | Liquid detergent (c) gram | Liquid detergent (d) gram |
|---|---|---|---|---|
| Alcohol(C12) Ethoxylate | 60 | 40 | 20 | 10 |
| Sodium lauryl Ether Sulphate | 20 | 5 | 10 | 5 |
| propyleneglycol | 20 | 0 | 10 | 0 |
| water | 11 | 90 | 30 | 70 |
| $Na_2SO_4$ | 0.6 | 17 | 10 | 22 |
| Total | 111.6 | 162 | 80 | 107 |
| Alcohol(C12) Ethoxylate | 54% | 25% | 25% | 9% |
| Sodium lauryl Ether Sulphate | 18% | 3% | 13% | 5% |
| propyleneglycol | 18% | 0% | 13% | 0% |
| water | 10% | 62% | 38% | 65% |
| $Na_2SO_4$ | 0.5% | 10.5% | 12.5% | 20.6% |
| Total | 100% | 100% | 100% | 100% |
| Appearance of detergent | Transparent | Trans-parent | Transparent | Transparent |
| Appearance of pouch after packaging | No wrinkle | Many wrinkles | No wrinkle | many wrinkles |
| Leakage after three months storage test at ambient conditions | No leakage | Leakage | No leakage | Leakage |

Example 2

The pouch was made from a 88 mol % hydrolyzed polyvinyl acetate (JP18, Japan Vam & Poval Co., Ltd) film. 18 wt % of glycerol was formulated in the film. The film thickness was 90 microns. The size of the pouch was 10 cm×15 cm. An outer package was 50 micron thick high density polyethylene. $K_2SO_4$, $Al_2(SO_4)_3$ or $MgSO_4$ was added in the liquid detergent. The results are shown in Tables 2-1 and 2-2.

TABLE 2-1

| | Liquid detergent (e) gram | Liquid detergent (f) gram | Liquid detergent (h) gram | Liquid detergent (i) gram |
|---|---|---|---|---|
| Alcohol(C12) Ethoxylate | 20 | 20 | 20 | 20 |
| Sodium lauryl Ether Sulphate | 10 | 10 | 10 | 10 |
| propyleneglycol | 10 | 10 | 10 | 10 |
| water | 8 | 30 | 30 | 70 |
| $K_2SO_4$ | 4 | 0 | 0 | 19 |
| $MgSO_4$ | 0 | 4 | 0 | 0 |
| $Al_2(SO_4)_8$ | 0 | 0 | 4 | 0 |
| Total | 52 | 74 | 74 | 129 |
| Alcohol(C12) Ethoxylate | 38% | 27% | 27% | 16% |
| Sodium lauryl Ether Sulphate | 19% | 14% | 14% | 8% |
| propyleneglycol | 19% | 14% | 14% | 8% |
| water | 15% | 41% | 41% | 54% |
| $K_2SO_4$ | 7.7% | 0.0% | 0.0% | 14.7% |
| $MgSO_4$ | 0.0% | 5.4% | 0.0% | 0.0% |
| $Al_2(SO_4)_8$ | 0.0% | 0.0% | 5.4% | 0.0% |
| Total | 100% | 100% | 100% | 100% |
| Appearance of detergent | Trans-parent | Translucent | Translucent | Transparent |
| Appearance of pouch after packaging | No wrinkle | No wrinkle | No wrinkle | No wrinkle |
| Leakage after three months storage test at ambient conditions | No leakage | No leakage | No leakage | No leakage |

TABLE 2-2

| | Liquid detergent (j) gram | Liquid detergent (k) gram | Liquid detergent (m) gram | Liquid detergent (n) gram |
|---|---|---|---|---|
| Alcohol(C12) Ethoxylate | 20 | 20 | 20 | 10 |
| Sodium lauryl Ether Sulphate | 10 | 10 | 10 | 5 |
| propyleneglycol | 10 | 10 | 10 | 0 |
| water | 80 | 30 | 100 | 70 |
| $K_2SO_4$ | 0.3 | 0 | 0 | 20 |
| $MgSO_4$ | 0 | 0.3 | 0 | 0 |
| $Al_2(SO_4)_8$ | 0 | 0 | 12 | 0 |
| Total | 70.8 | 70.3 | 152 | 105 |
| Alcohol(C12) Ethoxylate | 28% | 28% | 13% | 10% |
| Sodium lauryl Ether Sulphate | 14% | 14% | 7% | 5% |
| propyleneglycol | 14% | 14% | 7% | 0% |
| water | 43% | 43% | 66% | 67% |
| $K_2SO_4$ | 0.4% | 0.0% | 0% | 19.0% |
| $MgSO_4$ | 0.0% | 0.4% | 0% | 0.0% |
| $Al_2(SO_4)_8$ | 0.0% | 0.0% | 7.9% | 0.0% |
| Total | 100% | 100% | 100% | 100% |
| Appearance of detergent | Trans-parent | Transparent | Translucent | Transparent |
| Appearance of pouch after packaging | Wrinkles | Wrinkles | Many wrinkles | Many wrinkles |
| Leakage after three months storage test at ambient conditions | Leakage | Leakage | Leakage | Leakage |

Example 3

The pouch was made from a 94 mol % hydrolyzed polyvinyl acetate and maleic acid copolymer (T-350, Nippon Gohsei Co., Ltd) film. 10 wt % of glycerol was formulated in the film. The film thickness was 60 microns. The size of the pouch was 10 cm×15 cm. An outer package was 50 micron thick high density polyethylene. The results are shown in Table 3.

TABLE 3

| | Liquid detergent (a) | Liquid detergent (b) | Liquid detergent (h) | Liquid detergent (j) | Liquid detergent (k) |
|---|---|---|---|---|---|
| Appearance of pouch after packaging | No wrinkle | Many wrinkles | No wrinkle | Wrinkles | Wrinkles |
| Leakage after three months storage test at ambient conditions | No leakage | Leakage | No leakage | Leakage | Leakage |

Example 4

The pouch was made from a 99 mol % hydrolyzed polyvinyl acetate and 2-acrylamido-2-methylpropanesulfonic acid copolymer (Ultiloc 2025, Sekisui Chemical Co., Ltd) film. 30 wt % of trimethylolpropane was formulated in the film. The film thickness was 40 microns and 75 microns. The pouch was made by a vacuum molding method. The shape of the pouch was round and the diameter was 7 cm. The depth of the round pouch was 1.5 cm. An outer package was 50 micron thick high density polyethylene. The results are shown in Table 4.

TABLE 4

| | Liquid detergent (a) | Liquid detergent (b) | Liquid detergent (c) | Liquid detergent (e) | Liquid detergent (f) |
|---|---|---|---|---|---|
| Film thickness: 75 microns | | | | | |
| Appearance of pouch after packaging | No wrinkle | Many wrinkles | No wrinkle | No wrinkle | No wrinkle |
| Leakage after three months storage test at ambient conditions | No leakage | leakage | No leakage | No leakage | No leakage |
| Film thickness: 40 microns | | | | | |
| Appearance of pouch after packaging | No wrinkle | Many wrinkles | No wrinkle | No wrinkle | No wrinkle |
| Leakage after three months storage test at ambient conditions | Leakage | Leakage | Leakage | Leakage | Leakage |

Example 5

Liquid detergent (a) and (e) were packed with the pouch used at Example 4 having a thickness of 75 microns with and without inorganic salt respectively. The pouches were stored under 40 degrees Celsius for 2 weeks. The appearances of the pouches packed without $Na_2SO_4$ and $K_2SO_4$ were swollen and some leakage was observed. A film was cut off from each pouch and mounted in a 35 mm photo flame. The film fixed to the flame was dipped into rotating water at 10 degrees Celsius in a 1 liter beaker. Dissolution time was the time from the dipping to the disappearance of dispersed films in the water. The results are shown in Table 5.

TABLE 5

| | Liquid Detergent (a) | | |
|---|---|---|---|
| | | After storage | |
| | Before storage | without $Na_2SO_4$ | with $Na_2SO_4$ |
| Dissolution time (sec) of film | 80 | 120 | 84 |
| | Liquid Detergent (e) | | |
| | | After storage | |
| | Before storage | without $K_2SO_4$ | with $K_2SO_4$ |
| Dissolution time (sec) of film | 80 | 150 | 90 |

Accordingly, while several embodiments of the present invention have been described, it is obvious that many changes and modifications may be made thereunto without departing from the spirit and scope of the invention.

What is claimed is:

1. A detergent packet comprising:

a) a water soluble pouch formed from a film comprising: a copolymer of hydrolyzed vinyl acetate and a co-monomer selected from the group consisting of maleic acid and 2-acrylamido-2-methylpropanesulfonic acid; and b) a liquid or gel detergent contained within said water soluble pouch, said liquid or gel detergent comprising:

(i) between 15 wt % and 60 wt % water and (ii) between 0.5 wt % and 15 wt % inorganic sulfate.

2. The detergent packet according to claim 1, wherein a cation of said inorganic sulfate is selected from the group consisting of sodium, potassium, magnesium and aluminum.

3. The detergent packet according to claim 1, wherein a cation of said inorganic sulfate comprises sodium.

4. The detergent packet according to claim 1, wherein a degree of hydrolysis of said film expressed as a mol percentage of vinyl acetate units converted to vinyl alcohol units comprises 70 mol % to 100 mol %.

5. The detergent packet according to claim 1, wherein a thickness of said film is between 50 microns and 100 microns.

6. The detergent packet according to claim 1, further comprising an outer water soluble pouch packed with both said water soluble pouch and an outer liquid or gel detergent contained within said outer water soluble pouch, said outer liquid or gel detergent comprising:

i) less than 15 wt % of water; and ii) less than 10 wt % of inorganic sulfate.

7. The detergent packet according to claim 6, wherein a cation of said inorganic sulfate of said outer liquid or gel detergent is selected from the group consisting of sodium, potassium, magnesium and aluminum.

8. The detergent packet according to claim 6, wherein a cation of said inorganic sulfate of said outer liquid or gel detergent comprises sodium.

9. The detergent packet according to claim 6, wherein said outer water soluble pouch is formed from a film comprising at least one of:

(i) a polymer of hydrolyzed vinyl acetate; and (ii) a copolymer of hydrolyzed vinyl acetate and a co-monomer.

10. The detergent packet according to claim 9, wherein said co-monomer of said outer water soluble pouch is selected from the group consisting of maleic acid, itaconic acid, methyl acrylate and 2-acrylamido-2-methylpropanesulfonic acid.

11. The detergent packet according to claim 9, wherein a degree of hydrolysis of said outer water soluble pouch expressed as a mol percentage of vinyl acetate units converted to vinyl alcohol units comprises 70 mol % to 100 mol %.

12. The detergent packet according to claim 9, wherein a thickness of said film of said outer water soluble pouch is between 50 microns and 100 microns.

13. The detergent packet according to claim 1, wherein said film further comprises a polymer of hydrolyzed vinyl acetate.

* * * * *

UNITED STATES PATENT AND TRADEMARK OFFICE

CERTIFICATE OF CORRECTION

PATENT NO. : 8,802,612 B2
APPLICATION NO. : 13/752609
DATED : August 12, 2014
INVENTOR(S) : Wong et al.

It is certified that error appears in the above-identified patent and that said Letters Patent is hereby corrected as shown below:

Title page, Item [71] change "Alcello Chemical Co., Ltd." to correctly read:

--Aicello Corporation--.

Signed and Sealed this
Twenty-first Day of October, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,802,612 B2
APPLICATION NO. : 13/752609
DATED : August 12, 2014
INVENTOR(S) : Carlton J. Wong et al.

It is certified that error appears in the above-identified patent and that said Letters Patent is hereby corrected as shown below:

This certificate supersedes the Certificate of Correction issued on October 21, 2014. The certificate which issued on October 21, 2014 is vacated since the Applicant name on front page of patent was taken from the Applicant section of the Application Data Sheet (ADS). No request to change the applicant in compliance with 37 CFR 1.46(c) was filed during the pendency of the application. Since what is listed on the patent is correct relative to the patent application file record from which the patent issued, no correction is in order under 37 CFR 1.322 or 1.323. The Certificate of Correction which issued on October 21, 2014 was published in error and should not have been issued for this patent.

Signed and Sealed this
Ninth Day of June, 2015

Michelle K. Lee

Michelle K. Lee
*Director of the United States Patent and Trademark Office*